United States Patent [19]

Cathcart et al.

[11] Patent Number: 4,839,140

[45] Date of Patent: Jun. 13, 1989

[54] CHROMIUM MODIFIED NICKEL-IRON ALUMINIDE USEFUL IN SULFUR BEARING ENVIRONMENTS

[75] Inventors: John V. Cathcart, Knoxville; Chain T. Liu, Oak Ridge, both of Tenn.

[73] Assignee: The United States of America as represented by the United States Department of Energy, Washington, D.C.

[21] Appl. No.: 91,561

[22] Filed: Aug. 31, 1987

Related U.S. Application Data

[63] Continuation-in-part of Ser. No. 786,562, Oct. 11, 1985, Pat. No. 4,731,221.

[51] Int. Cl.[4] ..... C22C 19/05

[52] U.S. Cl. ..... 420/445; 420/446; 420/459

[58] Field of Search ..... 420/445, 446, 459; 148/428

[56] References Cited

U.S. PATENT DOCUMENTS 4,731,221 3/1988 Liu ..... 420/445

*Primary Examiner*—R. Dean

*Attorney, Agent, or Firm*—Katherine P. Lovingood; Stephen D. Hamel; William R. Moser

[57] ABSTRACT

An improved nickel-iron aluminide containing chromium and molybdenum additions to improve resistance to sulfur attack.

1 Claim, 3 Drawing Sheets

CHROMIUM MODIFIED NICKEL-IRON ALUMINIDE USEFUL IN SULFUR BEARING ENVIRONMENTS

This invention relates to Nickel-Iron Aluminide alloys suitable for use in sulfidizing environments and was developed pursuant to a contract with the U.S. Department of Energy.

This patent application is a continuation in part of previously filed patent application Ser. No. 786,562 filed on Oct. 11, 1985 now U.S. Pat. No. 4,731,221.

BACKGROUND

Ordered intermetallic alloys based on trinickel aluminide (Ni3Al) have unique properties that make them attractive for structural applications at elevated temperatures. They exhibit the unusual mechanical behavior of increasing yield stress with increasing temperature whereas in conventional alloys yield stress decreases with temperature. Trinickel aluminide is the most important strengthening constituent of commercial nickel-base superalloys and is responsible for their high temperature strength and creep resistance. The major limitation of the use of such nickel aluminides as engineering materials has been their tendency to exhibit brittle fracture and low ductility.

Recently alloys of this type have been improved by the additions of iron to increase yield strength, boron to increase ductility, and titanium, manganese and niobium for improving cold fabricability (U.S. patent application Ser. No. 519,941 filed Aug. 3, 1983, *Ductile Aluminide Alloys for High Temperature Applications,* Liu and Koch). Another improvement has been made to the base Ni3Al alloy by adding iron and boron for the aforementioned purposes and, in addition, hafnium and zirconium for increased strength at higher temperatures (U.S. patent application Ser. No. 564,108 filed Dec. 21, 1983, *Ductile Aluminide Alloys for High Temperature Applications,* Liu and Steigler). Further improvements were made to these alloys by increasing the iron content and also adding a small amount of a rare earth element, such as cerium, to improve fabricability at higher temperatures in the area of 1,200C, (U.S. patent application Ser. No. 730,602 filed May 6, 1985, *High-Temperature Fabricable Nickel-Iron Aluminides,* Liu). Most recently, these alloys were improved by the addition of chromium to increase ductility at elevated temperature in oxidizing environments (commonly assigned and copending U.S. patent application Ser. No. 786,562 filed Oct. 11, 1985, *Nickel Aluminides and Nickel-Iron Aluminides for Using in Oxidizing Environments,* Liu). These U.S. patent applications are incorporated herein by reference. These alloys have many favorable characteristics including improved ductility, tensile strength and resistance to oxidation, all of which are desirable for structural use in advanced coal conversion systems. However, another property necessary to such uses is a resistance to sulfur attack.

SUMMARY OF THE INVENTION

In view of the above need, it is an object of this invention to provide an alloy that is resistant to sulfur attack at elevated temperatures.

It is another object of this invention to provide an alloy that is suitable for structural applications at high temperatures in environments that contain sulfur. A final object of this invention is to provide an alloy based on the nickel-iron-chromium-aluminide intermetallic alloy system that has good strength, ductility, creep properties and corrosion properties for use in high temperature, sulfur-bearing environments. Other objects and advantages will become obvious to persons skilled in the art upon study of the specifications and appended claims.

This invention is an alloy comprising 18 to 19 at. % aluminum, 10 to 11.5 at. % iron, 6.5 to 8.0 at. % chromium, 0.4 to 0.8 at. % molybdenum, 0.1 to 0.3 at. % zirconium, 0.05 to 0.2 at. % boron and the balance being nickel.

The alloy possesses properties, particularly high temperature strength and resistance to sulfidization, that makes it useful for structural use in coal conversion systems and other high temperature, sulfur-bearing environments.

DETAILED DESCRIPTION OF THE PREFERRED EMBODIMENT

Figure 1:
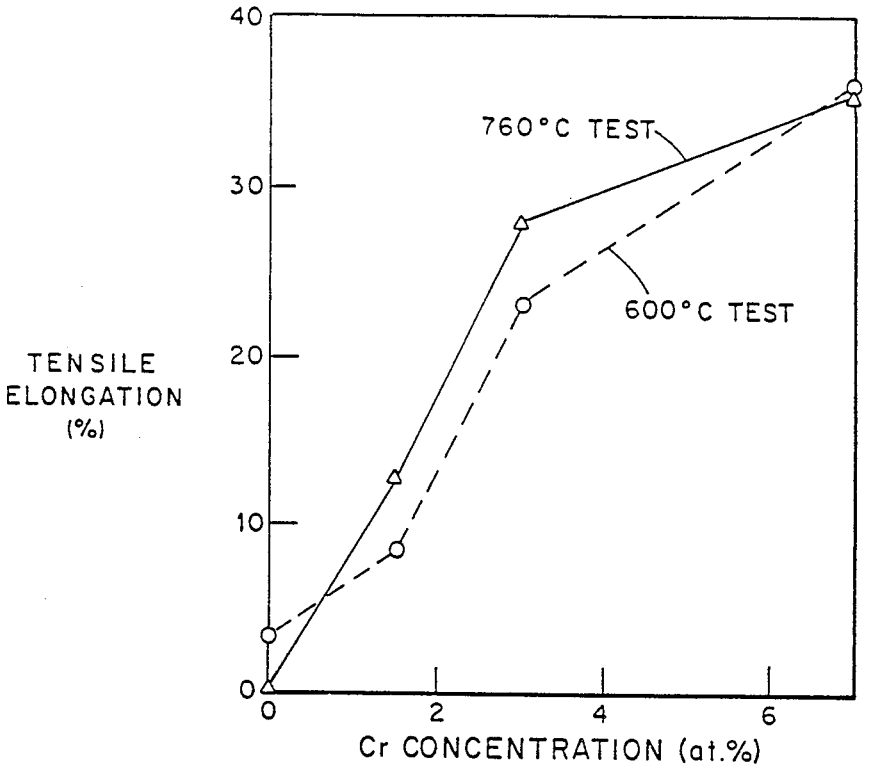
FIG. 1 is a plot of tensile elongation as a function of chromium content in nickel-iron aluminides containing 15.5 at. % Fe tested in air at 600° and 760° C.

The composition of the claimed invention is within the compositional range of the claims of the parent patent application; however, the compositional range of the claim of this application is critical and specific to characteristics related to resistance to sulfur corrosion as well as improved ductility and creep resistance. To demonstrate this invention, specimens prepared by standard laboratory procedures were subjected to standard capsule tests which involved exposure of the alloys to the gaseous decomposition products of $CaSO_4$ in a sealed quartz capsule for 168 hours for 871° C. Upon heating, $CaSO_4$ decomposes to calcium oxide, oxygen and sulfur. Weight gained by the specimens during the corrosion test was used as a measure of sulfide corrosion. The mechanical properties of the aluminide alloys were measured by both tensile and creep test.

Chromium present in about 7 at. % inhibits the sulfur attack on the alloy and improves ductility; however, creep resistance decreases with increased chromium content. Therefore, it was necessary to keep the chromium content as low as possible and yet have a sufficient amount to resist sulfidization. To improve creep properties, Al and Fe contents were limited but corrosion resistance suffered. Further development of the alloy became a balancing act of substituents to maximize advantages and minimize disadvantages. Aluminum content was best limited to below 20 at. % to maintain sufficient creep properties which were best at about 18.5 at. %. Although at 20 at. % aluminum, iron content could vary from 10 to 15.5 at. %, at lower aluminum content of about 18.5 at. % the corrosion rate became very sensitive to iron, thus requiring the iron content of the low aluminum content alloy to be restricted to about 10 at. %. It was discovered that chromium, which was added in place of nickel, must be present in conjunction with iron, and, likewise, iron must have the pressure of chromium for sulfur resistance to be realized. Surprisingly, a small amount of molybdenum further improves corrosion resistance.

TABLE 1

| Alloy number | Alloy addition (at. %) | Creep rupture time (h) | Rupture ductility (%) |
|---|---|---|---|
| | Creep properties of nickel-iron aluminides tested at 760° C. and 138 MPa (20 ksi) | | |
| | (a) 15% Fe + X% Cr | | |
| IC-165 | 0 (base composition) | 156 | 25.8 |
| IC-197 | 1.5 Cr | — | — |
| IC-167 | 3.0 Cr | 61 | 33.4 |
| IC-199 | 6.7 Cr | — | — |
| IC-168 | 7.0 Cr | 31 | 45.4 |
| | (b) 7% Cr + X% Fe | | |
| IC-304 | 12.3 Fe | 31 | 48.9 |
| IC-333 | 10.0 Fe | 77 | 60.7 |
| IC-334 | 9.0 Fe | 89 | 40.6 |
| IC-335 | 8.0 Fe | 167 | 33.5 |
| | (c) 7% Cr + 10–10.5% Fe + X% Al | | |
| IC-320 | 20 Al | 18 | 64.0 |
| IC-331 | 19.8 Al | 40 | 52.8 |
| IC-333 | 19.0 Al | 77 | 60.7 |
| IC-347 | 18.5 Al | 173 | 35.7 |
| IC-336 | 18.0 Al | 245 | 48.2 |
| | (d) 7% Cr Ni—Fe aluminides* with Mo or Ti | | |
| IC-347 | 0 | 173 | 34.8 |
| IC-348 | 0.24 Ti | 186 | 25.7 |
| IC-349 | 0.74 Ti | 91 | 27.4 |
| IC-356 | 0.75 Ti | 80 | 23.8 |
| IC-350 | 1.24 Ti | 85 | 54.8 |
| IC-351 | 1.74 Ti | 41 | 79.5 |
| IC-364 | 0.3 Mo | 100 | 98.4 |
| IC-357 | 0.74 Mo | 220 | 42.0 |
| IC-365 | 1.50 Mo | 115 | 98.0 |

*All alloys contain 10% Fe except the alloy IC-356 containing 11% Fe.

EXAMPLE 1

Figure 2:
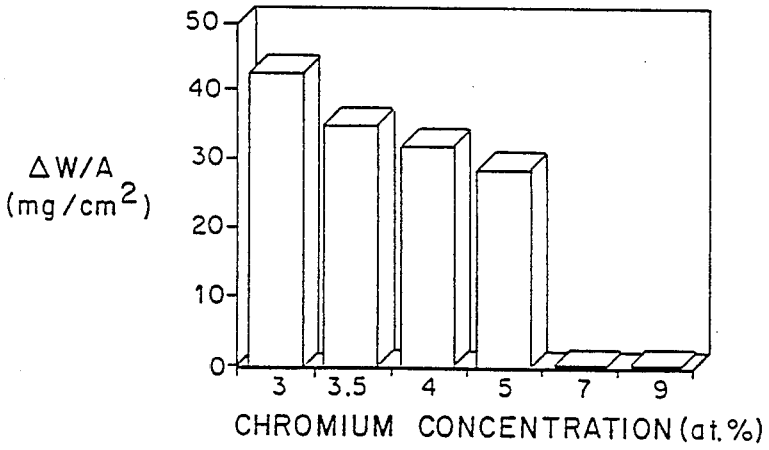
FIG. 2 shows weight gain as a function of Cr Concentration in as-polished Ni-20% Al-12.3 at. % Fe alloys exposed to a sulfidizing environment at 871° C. for 168 hours.

A series of nickel-iron aluminide alloys were prepared in which chromium was added and the nickel content correspondingly reduced. All the alloys were fabricated into sheet stock without difficulty. The chromium addition has a dramatic affect on ductilities of the nickel-iron aluminide at 600° and 760° C. as shown in FIG. 1. The base aluminide containing no chromium elongated less than 4% at these temperatures. The elongation increased sharply with increasing chromium content and reached 35% for the alloy that was 7 at. % chromium. These results clearly demonstrated that the environmental embrittlement at elevated temperatures can be effectively reduced by alloying with chromium. The creep properties of these chromium modified alloys were also determined at 138 MPa and 760° C. Limited creep data in Table 1, Part (a) below, indicate that the creep resistance of the nickel-iron aluminides decreases with the increasing chromium content. Alloying with 7 at. % chromium lowered the creep rupture life by a factor of 5. Although it enhances tensile ductility in oxidizing environments, chromium is detrimental to the creep resistance of the nickel-iron aluminides. Neither iron nor chromium additions alone improved the sulfidization resistance of $Ni_3Al$, but when both iron and chromium were added to the base alloy, a dramatic decrease in sulfur attach occurred if the chromium content of the alloy was at least 7 at. %. FIG. 2 illustrates this result in the form of a bar graph showing the weight gains for a series of Ni-20% Al-12.3 at. % Fe alloys containing various amounts of chromium. Although not shown in the figure, tests were also made with an alloy containing 6% chromium and the results were erratic suggesting that this a marginal level for chromium content.

EXAMPLE 2

Corrosion studies discussed in an Example 1 indicated that 7 at. % chromium addition is needed to protect nickel-iron aluminides in sulfur bearing environments. To improve the creep resistance, the effect of iron concentration of 7% chromium nickel-iron aluminides containing 8 to 12.3% iron was studied as shown in Table 1, Part (b). All alloys were successfully fabricated into sheet materials by hot or cold rolling except that IC-335 containing the lowest level of iron at 8 at. % cracked quite badly during the hot rolling at 1150° C. Tensile data show that the ductility is not sensitive to iron content in the range of 8 to 10 at. %. The yield strength of the nickel-iron aluminides increased with increasing iron at room temperature but decreased at 800° C. The creep properties of this series were also determined at 178 MPa and 760° C. and are listed in Table 1, Part (b). The aluminides show a general trend of increasing creep resistance with decreasing the iron content. Among the alloys IC-335 having the lowest iron level had the longest creep rupture life.

EXAMPLE 3

Figure 3:
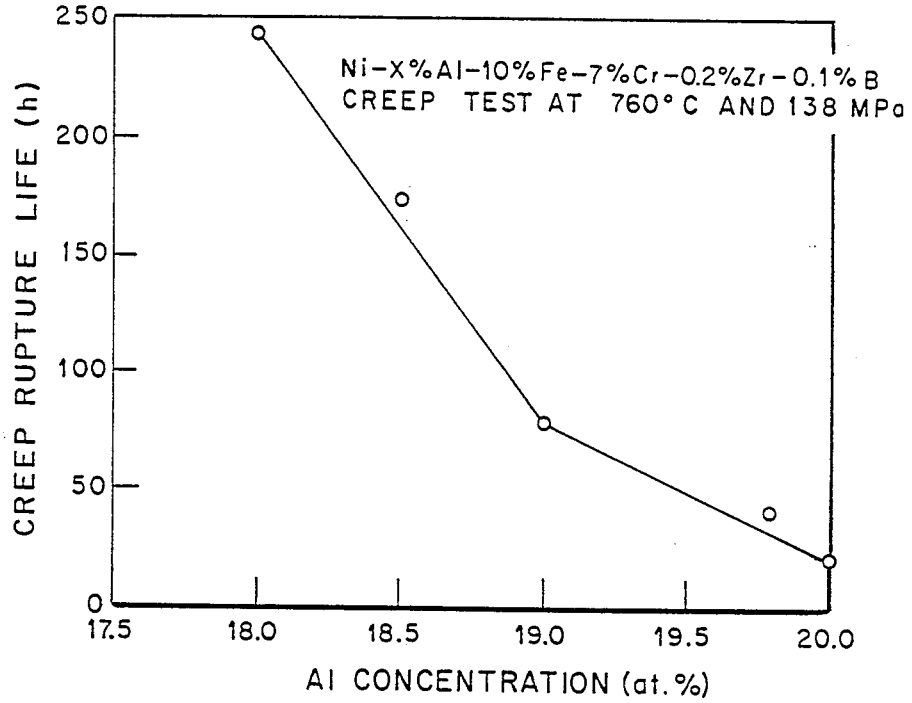
FIG. 3 is a plot of creep rupture life as a function of Al concentration in Ni-Fe aluminides tested at 760° C. at 138 MPa.

The second series of 7 at. % chromium alloys was prepared for studying the effect of aluminum content on the properties of nickel-iron aluminides containing 10.0–10.5% iron and 7% chromium as shown in Table 1, Part (c). All alloys were fabricated into sheets by cold or hot rolling without major difficulty. The tensile data obtained at elevated temperatures show that the alloys exhibit an increase in strength with decreasing aluminum, with ductility essentially insensitive to aluminum content. The creep properties of these alloys are also summarized in Table 1, Part (c) and are plotted in FIG. 3 as a function of aluminum concentration. The results clearly show an increase in rupture life with decreasing aluminum concentration. The decrease of aluminum from 20 to 18% resulted in an increase in rupture life by more than a order of magnitude. Among all 7 at. % chromium aluminides, IC-336 had the best creep resistance.

EXAMPLE 4

Alloying additions of titanium and molybdenum up to 1.75 at. % were added to 7 at. % chromium Ni-Fe aluminides to further improve their metallurgical and mechanical properties. All alloys with compositions listed in Table 1, Part (d) were prepared by arc melting and drop casting. The alloy ingots were successfully fabricated into sheet materials by hot and cold rolling except that IC-350, IC-351, and IC-365 cracked during cold fabrication. Tensile properties of the aluminides were not strongly dependent on alloy additions of titanium and molybdenum up to 1%. The creep properties of the aluminides shown in Table 1, Part (d) were not affected by alloying with 0.24 at. % titanium and above that level the creep rupture life decreased with titanium. The creep properties were basically not sensitive to molybdenum additions although the aluminide with 0.74% molybdenum, IC-357, had better creep resistance than that of the other alloys in this series. Both titanium and molybdenum, however, significantly improved the corrosion resistance of the nickel-iron aluminides as shown in the next example.

EXAMPLE 5

In all of the corrosion tests performed with as-polished specimens, no specimen with less than 7 at. % chromium exhibited significant sulfidization resistance. However, the effect of varying the concentrations of iron and aluminum was considerably more complex. When the concentration of aluminum is relatively high at approximately 20 at. %, the corrosion rate is relatively insensitive to the iron concentration over a range from 8 to 15 at. % iron. A decrease in the aluminum concentration greatly increases the sensitivity of the corrosion rate to the iron concentration. While the iron concentration was relatively unimportant for alloys containing 20% aluminum, reducing the concentration of aluminum to 18%, which is desirable for mechanical properties, required iron concentrations of 12 at. % or higher to provide reasonable resistance to sulfidization attack in the capsule test. The difficulties associated with the use of these low concentrations of aluminum and iron can be alleviated to a considerable extent through a small addition of titanium or molybdenum. For example, the alloy IC-356 containing 18.5 Al-11 Fe-0.75 Ti experienced the smallest weight gain of 0.10 mg/cm$^2$ in a capsule test of all the alloys investigated. Comparable alloys without titanium exhibited weight gains between 1 and 2 orders of magnitude higher. Molybdenum additions were almost equally effective in the alloy IC-357 containing 18.5 at. % Al and 10 at. % Fe. Additions of 0.25 at. % titanium were also tested but were less effective. The protective oxide layer on these latter samples tended to break down at the edges and the corners of the specimens although the central flat regions of the specimen remained essentially unattached.

Figure 4:
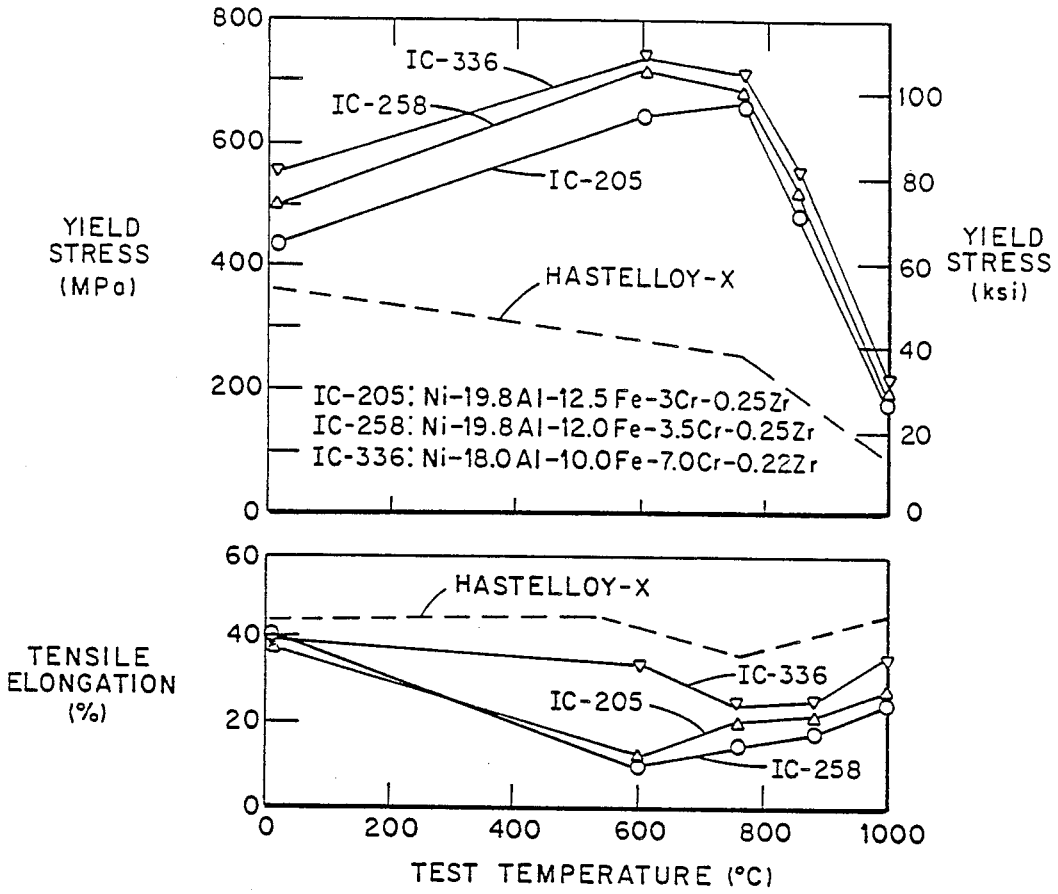
FIG. 4 is a comparison of tensile properties of Ni-Fe aluminides IC-205 and IC-258 with Hastelloy X.

The results indicate that at 7 at. % chromium, the alloys can protect the nickel-iron aluminides in sulfur-bearing environments and further that the iron and aluminum contents must be below about 12 and 19 at. %, respectively, in order to obtain good creep resistance. Alloying with 0.7 at. % molybdenum effectively improves the corrosion resistance of the low aluminum and iron aluminides without sacrificing their good creep resistance. The study of alloying effects have led to the development of nickel-iron aluminides for structural use in coal-conversion systems. The aluminide has excellent tensile strength and is much stronger than commercial alloys such as Hastelloy X and stainless steels, especially at elevated temperatures as shown in FIG. 4. The creep resistance of the aluminides is much better than that of austenitic steels and moderately better than of Hastelloy X as shown in Table 2, below.

TABLE 2

Comparison of creep properties[a] of nickel-iron aluminides with commercial alloys Hastelloy X and austenitic steel 316

| | Creep rupture life (h) | | Rupture ductility (%) | |
|---|---|---|---|---|
| Alloy number | 40 ksi | 20 ksi | 40 ksi | 20 ksi |
| IC-159 (0% Cr) | 12 | 306 | 14.0 | 5.5 |
| IC-205 (3% Cr) | 53 | 289 | 17.1 | 22.6 |
| IC-258 (3.5% Cr) | 40 | 383 | 17.8 | 6.4 |
| IC-336 (7.0% Cr) | — | 245 | — | 48.2 |
| IC-357 (7.0% Cr) | — | 220[c] | — | — |
| H-X (22% Cr) | 2[b] | 150 | 40[b] | 40 |
| Type 316 SS | <1[b] | 60 | 30[b] | 30[b] |

[a]Tested at 760° C.
[b]Estimated by extrapolation.
[c]The alloy contains 0.75% Mo.

We claim:

1. A composition of matter consisting essentially of 18 to 19 at. % aluminum, 10 to 11.5 at. % iron, 6.5 to 8.0 at. % chromium, 0.4 to 0.8 at. % molybdenum, 0.1 to 0.3 at. % zirconium, 0.05 to 0.2 at. % boron and the balance nickel.

* * * * *